United States Patent [19]

Quest

[11] Patent Number: 4,597,231

[45] Date of Patent: Jul. 1, 1986

[54] ANGULAR CAP FOR DRESSING AND STABILIZING OFFICE PARTITIONING

[76] Inventor: Thomas A. Quest, 9205 Timberline Dr., Omaha, Nebr. 68152

[21] Appl. No.: 663,409

[22] Filed: Oct. 22, 1984

[51] Int. Cl.[4] ..... E04B 2/76; E04B 2/74

[52] U.S. Cl. ..... 52/239; 52/285

[58] Field of Search ..... 52/234, 239, 285, 126.3, 52/126.4, 285, 658

[56] References Cited

U.S. PATENT DOCUMENTS

| | | | |
|---|---|---|---|
| 1,644,519 | 10/1927 | Gurisch | 52/658 X |
| 1,881,356 | 10/1932 | Gold | 52/285 X |
| 2,607,972 | 8/1952 | Rust | 52/285 X |
| 2,737,266 | 3/1956 | Gross | 52/234 X |
| 3,217,085 | 11/1965 | Lindgren | 52/285 X |
| 3,570,200 | 3/1971 | Ritner | 52/126.4 |
| 3,736,599 | 6/1973 | Kessler et al. | 52/285 X |
| 4,034,463 | 7/1977 | Ryan | 52/239 X |
| 4,118,903 | 10/1978 | Coulthard | 52/285 |

*Primary Examiner*—Alfred C. Perham

*Attorney, Agent, or Firm*—George R. Nimmer

[57] ABSTRACT

Angular caps for aesthetically dressing and for stabilizing the upper portion of conventionally intersecting office partitions include an angular roof-plate and several integrally attached depending vertical-plates.

Gaps between the roof-plate and the vertical-plates are reinforced with dual-trapezoidal gusset-plates to insure that the angular cap securely and aesthetically embraces the upper portions of intersecting office partitions.

10 Claims, 16 Drawing Figures

ANGULAR CAP FOR DRESSING AND STABILIZING OFFICE PARTITIONING

BACKGROUND OF THE INVENTION

The angular cap described and claimed as the present invention is for aesthetically dressing and for stabilizing the upper portion of office partitioning where conventional individual partitions meet.

Though conventional office partitions exist in numerous commercial styles and models, drawing FIGS. 1 and 2 schematically illustrate in a generic sense such conventional office partitions and the problems attendant at their partitioning meeting stations. Drawing FIGS. 1 and 2 are top plan and side elevational views, respectively, of a representative office environment 100 having horizontal office-ceiling 104 loftily overlying horizontal office-flooring 101 and having ceiling-height office-walls 105, 106, 107, 108, and 109. Representative office environment 100 also includes less than ceiling-height partitioning (e.g. 110) defining cubicle work-areas, each being providable with office furniture "Y" shown in phantom line.

Such generically depicted office partitioning (110) comprises a plurality of individual rectangular upright partitions P (e.g. P1, P2, P3, P4, P5, P6, etc.) respectively having a linearly extending horizontal base-edge E and a linearly extending flat horizontal top-edge T, respective partitions P extending vertically uprightly from the office-flooring (e.g. 101) whereby top-edge T loftily overlies base-edge E and office-flooring thereunder. Typically, individual partitions are structurally formed of a large rectangular panel K fitted with a horizontal base-channel EC defining partition base-edge E and a horizontal top-channel TC defining partition top-edge T. The top-channel two opposed sides which depend from top-edge T might define parallel upright-faces F for individual partitions P.

In such generic office partitioning (e.g. 110), there are partitions meeting stations S located remote of the office-walls and whereat the top-edge T of at least two meeting partitions P assume a corner-like angular relationship. For example, such corner-like relationships might occur: when partitions P1 and P4 meet in an L-shaped relationship at station S1; when partitions P3 and P4 meet in an L-shaped relationship at station S2; when partitions P5 and P6 meet in a T-shaped relationship at station S4; and when partitions P2, P4, and P5 meet in a +-shaped relationship at station S3. Ideally, for the sake of partitioning aesthetics and stability, individual partitions P should very closely firmly abut at every meeting station S. However, in practice this ideal seldom occurs, but rather, at the respective meeting stations S, the prior art is plagued with the existence of one or more transversely extending discontinuity (G) between part partitions P. Such objectionable discontinuities (G), which exist in the form or partially or wholly uninterrupted air-gaps between partitions P as known in the prior art are commonly of such magnitude that the partitioning (e.g. 110) has an unsightly unaesthetic appearance where partitions top-edges (T) meet. Some prior art workers have attempted to remedy this problem by trying to accurately measure and fit the upper portions of meeting partitions; however, these attempts are fraught with excessive expenditures of time and with little practical success. Besides being unsightly, these discontinuities (G) at the partitioning upper portions (T) detract from the partitioning stability, there being markedly less resistance to transversely extending forces at top-edges T than at base-edges E.

OBJECT OF THE INVENTION

It is accordingly the general objective of the present invention to provide economical and reliable means for improving the aesthetic appearance and stability of numerous conventional office partitioning, said improvements being attainable in a reliable and economical manner within normally encountered office environments.

GENERAL STATEMENT OF THE INVENTION

With the aforestated general objective in view, and together with other specific objectives which will become apparent as this description proceeds, the means herein for improving the aesthetic appearance and for stabilizing office partitioning generally comprises the furnishing of special angular caps for installation at respective partitioning meeting stations and in particular at the upper portion where top-edges of individual partitions meet, and thereby aesthetically obscuring the inter-partition discontinuity and also stabilizing the partitioning, each angular cap comprising a plural-wings roof-plate wherein respective wings are superimposable upon the meeting partitions' top-edges and wherein the number of wings equal the number of meeting partitions, and each angular cap further comprising a pair of parallel vertical-plates depending from opposed edges of each wing and abutting both upright-faces of the partition upon which the wing is superimposed, whereby the roof-plate central-part and the several vertical-plates aesthetically obscure the one or more transversely extending discontinuities between meeting partitions and strngthens the partitioning thereat, the angular cap preferably being provided of a single patterned-piece of metal and together with a cornerwise gusset-place reinforcement, and together with other permissible optional features which will be described.

BRIEF DESCRIPTION OF THE DRAWING

In the drawing, wherein like characters refer to like parts in the several views, and in which.

DETAILED DESCRIPTION OF THE DRAWING

Figure 3:
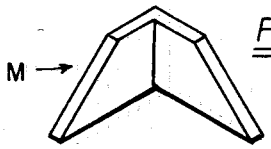
FIG. 3 is a perspective view of a gusset-plate component M utilized in representative embodiments of the angular cap.

As represented by the three embodiments (10, 40, and 70), the angular cap invention for aesthetically dressing and stabilizing office partitioning (e.g. 110) at the upper portion of respective meeting stations (e.g. S1, S2, S3, S4) generally comprises a horizontal roof-plate portion (20, 50, 80) having a plurality of wings merging together at a roof-plate central-part (25, 55, 85). Thus, as alluded to in drawing FIGS. 13–15, the roof-plate central-part is adapted to superimposably obscure the one or more transversely extending discontinuities (G) of a meeting station and the roof-plate wings are adapted to be superimposed upon each of the individual partitions top-edges (T) meeting at a said partitioning station (S). In addition to the roof-plate portion, the angular cap comprises a pair of parallel stiff vertical-plates (e.g. 31, 32, 92, etc.) depending from the roof-plate wings secondary-edges, said paired vertical-plates at their inner-faces snugly abutting both upright-faces (F) of an individual partition (P) e.g. at the vertical sides of top-channel TC. Thus, the combination of the roof-plate and the paired vertical-plates depending from the respective roof-plate wings together aesthetically obscure and stabilize the partitioning, namely at upper portions thereof at inter-partitions discontinuities (G). Preferably, all roof-plate all roof-plate wings and all vertical-plates are fabricated from a single patterned-piece (e.g. 10D, 40D, 70D) of sheet metal having a thickness within the approximate range of 0. to 0. inch and having sliver-like cutaways (39) terminating at the ultimate right-angled corner i.e. where vertical-plates from neighboring wings intersect. In addition to the patterned-piece, there is desireably a gusset-plate reinforcement (e.g. M of FIG. 3) attached (as by spot welding) at said right-angled upright corners and in a non-interfering relationship to the vertical-plates inner-faces. As indicated in FIG. 3, gusset-plate M is of dual-trapezoidal shape. Each of the vertical-plates is preferably provided with one or more apertures (35) utilizeable for the passage therethrough of pop-rivet or other fastener to augment the snug abutment between the vertical-plates and the partitions upright-faces F.

Figure 1:
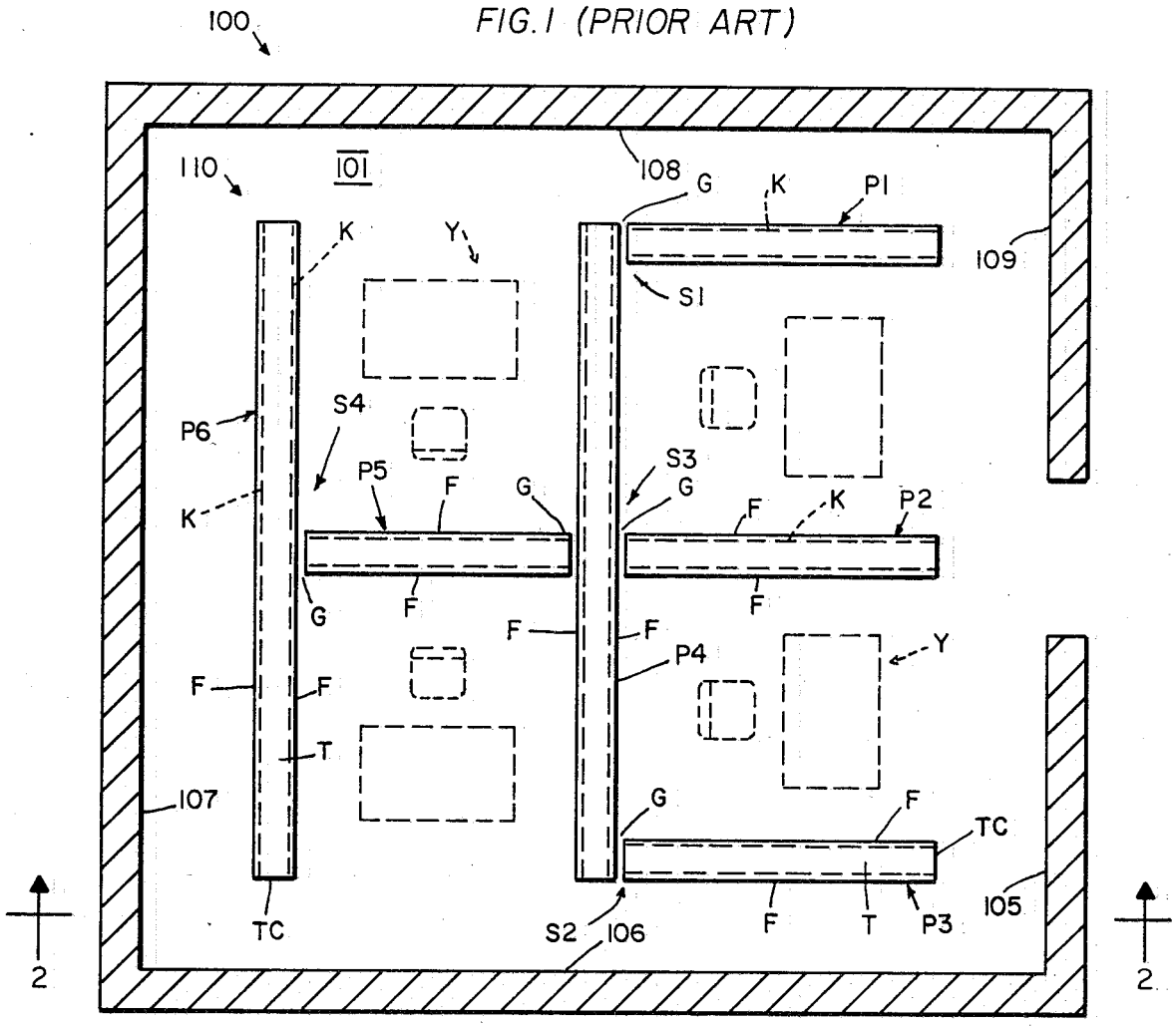
FIG. 1 (PRIOR ART)
FIG. 1 is a top plan view of the previously described prior art office environment and taken along line 1—1 of FIG. 2.
Figure 2:
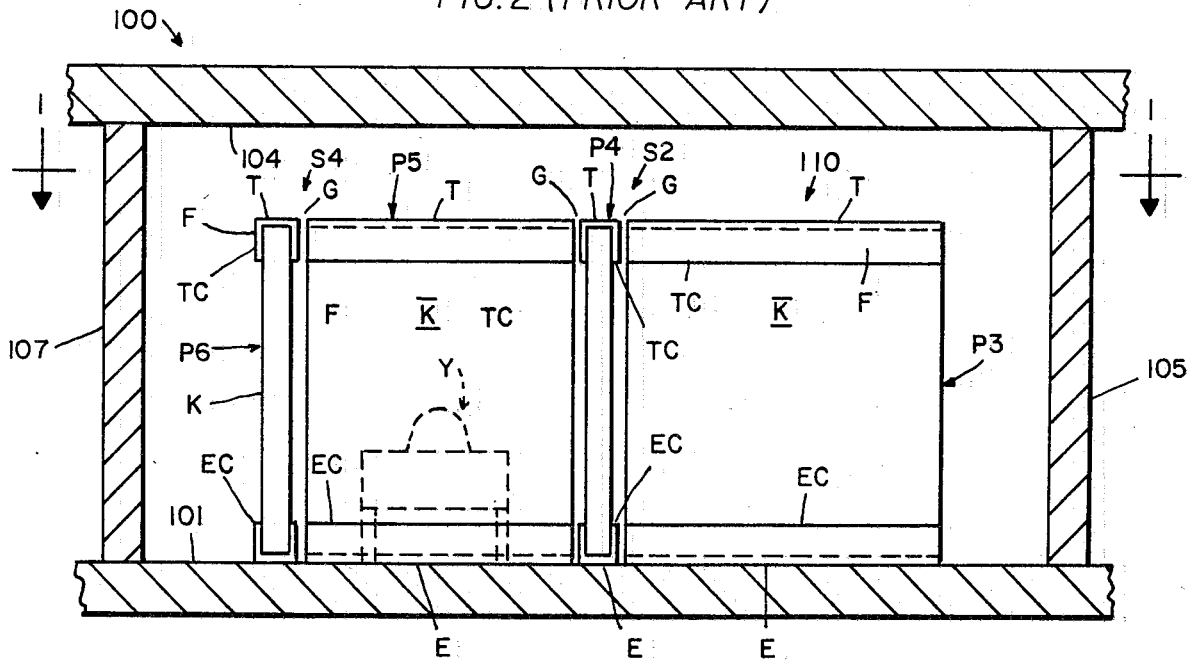
FIG. 2 (PRIOR ART)
FIG. 2 is a side elevational view of the previously described prior art environment and taken along line 2—2 of FIG. 1.
Figure 4:
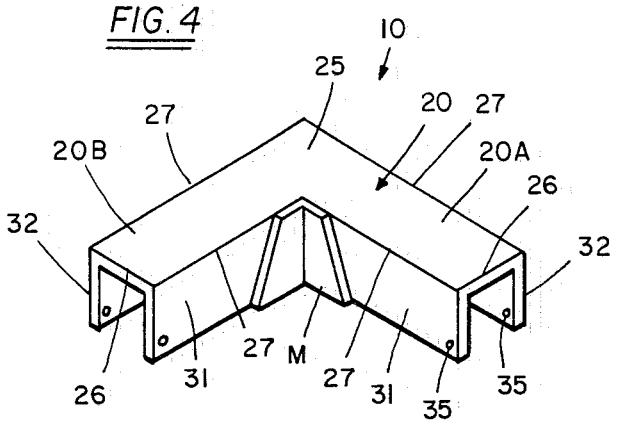
FIG. 4 is a perspective of the outer-side of a first embodiment (10) angular cap of the present invention.
Figure 5:
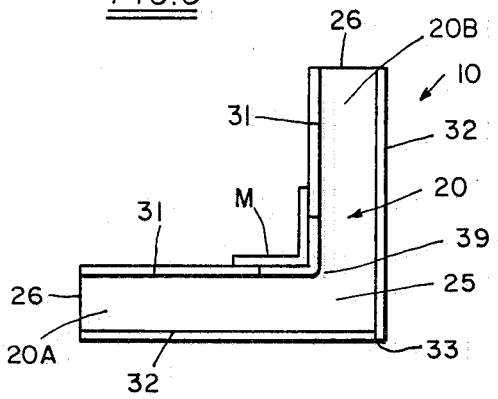
FIG. 5 is a bottom plan view and showing the inner-side of the first embodiment.

Turning to drawing FIGS. 4–5 which depict a two-wings angular cap embodiment 10 adaptable for use at such partitioning meeting stations (e.g. S1, S2) where two individual partition P meet in an L-shaped relationship. Horizontal planar roof-plate portion 20 includes two similarly lengthy and perpendicularly intersecting wings 20A and 20B arranged in an L-shaped condition, each wing having three linearly extending prominent wing-edges. The three wing-edges include two-substantially parallel secondary-edges 27 flanking a primary-edge 26. Of the three wing-edges primary-edge 26 is located most remote from the roof-plate central-part 25 and perpendicularly intersects the two secondary-edges 27.

Figure 13:
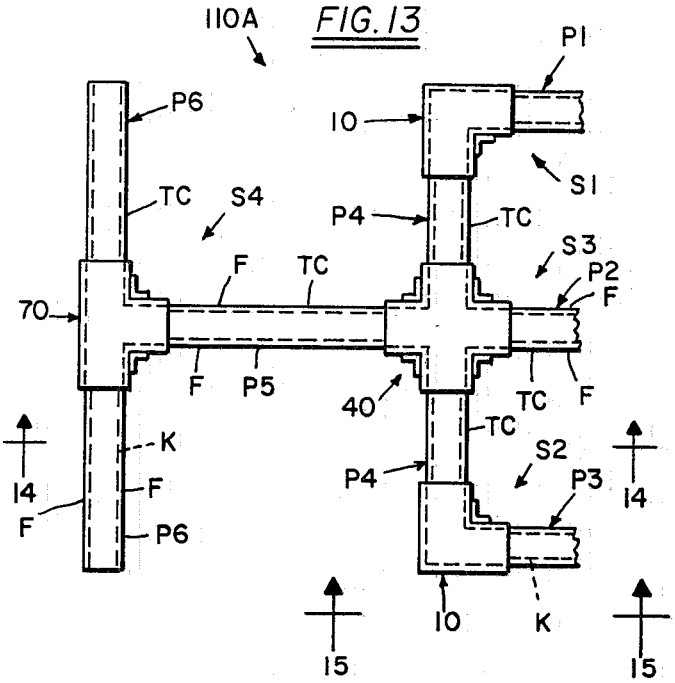
FIG. 13 is a top plan view showing partitioning portions of FIG. 1 and showing the angular caps of FIGS. 4–12 installed at appropriate meeting stations thereof.
Figure 15:
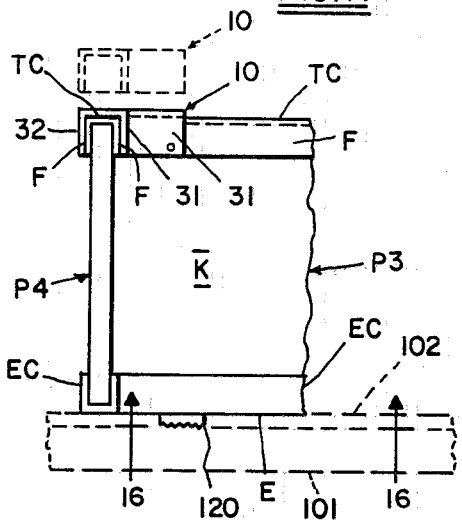
FIG. 15 is a sectional elevational view taken along line 15—15 of FIG. 13 and additionally showing a serrated foot-plate.
Figure 14:
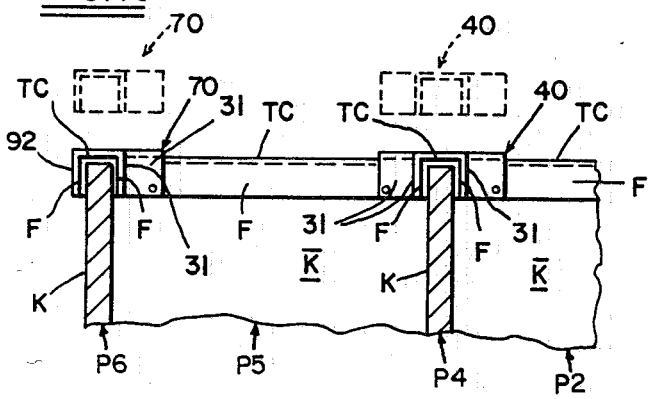
FIG. 14 is a sectional elevational view taken along line 14—14 of FIG. 13.

Angular cap embodiment 10 also includes four stiff vertical-plates (31, 32) respectively confined to and extending integrally perpendicularly downwardly from the respective roof-plate secondary-edges 27. Thus, the two primary-edges 26 of roof-plate 20 are devoid of such downward extensions. Each vertical-plate includes an upright inner-face located on the inner-side (FIG. 5) of the angular cap and an outer-face located at the angular cap outer-side. As best seen in FIG. 5, the two slightly lengthier vertical-plates 32 from neighboring wings 20A and 20B meet at cap corner 33, and the two somewhat shorter vertical-plates 31 from neighboring wings 20A and 20B define the cap right-angled corner (e.g. at 39) carrying a gusset-plate reinforcement M at the cap outer-side. The gusset-plate M, which at the vertical-plates outer-face aesthetically obscures the respective cutaways 39, also strengthens the angular cap thereat. Hence, as shown in FIGS. 13 and 15, the gusset-plate M confined to the vertical-plates outer-face, is in non-interfering relationship to the required snug abutment between the vertical-plates and the individual partitions upright-faces F.

Figure 6:
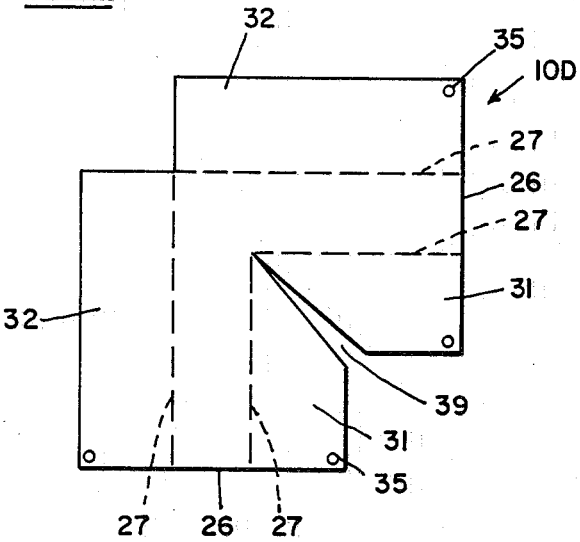
FIG. 6 is a top plan view of a patterned-piece utilizeable for manufacturing the angular cap first embodiment.

The dual-wings roof-plate 20 and the four vertical-plates of angular cap embodiment 10 might be fabricated from a single patterned-piece 10D of said metallic sheet material and having the shape substantially depicted in FIG. 6. Broken lines in FIG. 6 indicate linearities of patterned-piece 10D corresponding to the eventual locations of the wings secondary-edges 27. After the patterned-piece 10D is permanently bent at right angles along linearities 27, there results the appropriate dual-wings roof-plate 20 and the four rectangular vertical-plates (31, 32). Finally, as previously alluded to, the metallic gusset-plate dress and reinforcement M is attached to the bent patterned-piece to complete angular cap 10 for use at partitioning meeting stations S1, S2.

Figure 7:
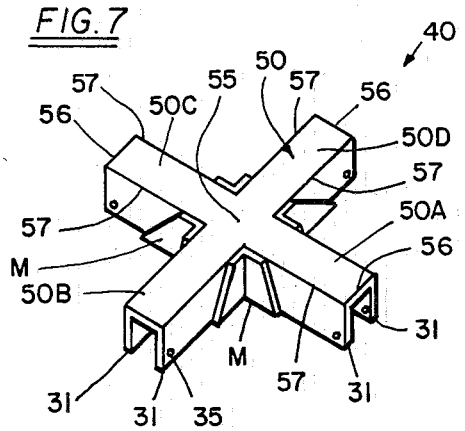
FIG. 7 is a perspective view of the outer-side of a second embodiment (40) angular cap of the present invention.
Figure 8:
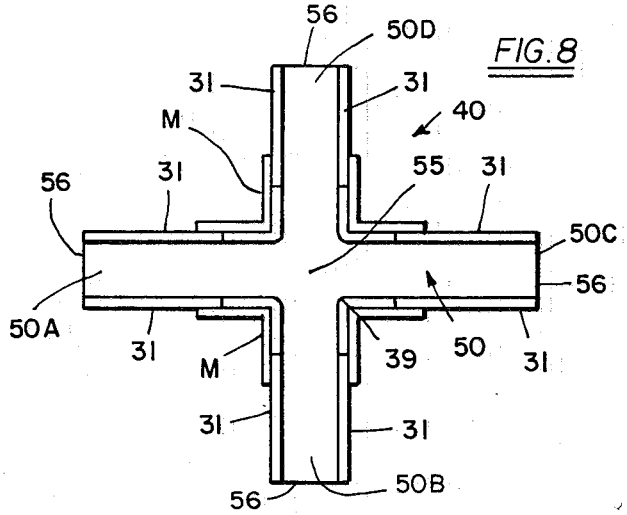
FIG. 8 is a bottom plan view and showing the inner-side of the second embodiment.

Turning next to drawing FIGS. 7–8 which depict a four-wings angular cap embodiment 40 adaptable for use at such partitioning meeting stations (e.g.S3) where individual partitions P meet in a +-shaped relationship. Horizontal planar roof-plate portion 50 includes four similarly lengthy and perpendicularly intersecting wings 50A, 50B, 50C, and 50D arranged in a +-shaped condition, each wing having three linearly extending prominent wing-edges. The three wing-edges include two substantially parallel secondary-edges 57 flanking a primary-edge 56. Of the three wing edges, primary-edge 56 is located most remote from the roof-plate central-part 55 and perpendicularly intersects the two secondary-edges 57.

Angular cap embodiment 40 also includes eight stiff rectangular vertical-plates 31 respectively confined to and extending integrally perpendicularly downwardly from the respective roof-plate secondary-edges 57. Thus, the four primary-edges 56 of roof-plate 50 are devoid of such downward extensions. The two vertical-plates 31 from each of the respective neighboring roof-plate wings define four upright right-angled corners for cap embodiment 40, and each said corner carrying a gusset-plate reinforcement M at the cap outer-side. Hence, as shown in drawing FIGS. 13–14, the gusset-plates M, confined to the vertical-plates outer-faces, is in non-interfering relationship to the required snug abutment between the vertical-plates and the individual partitions upright-faces F.

Figure 9:
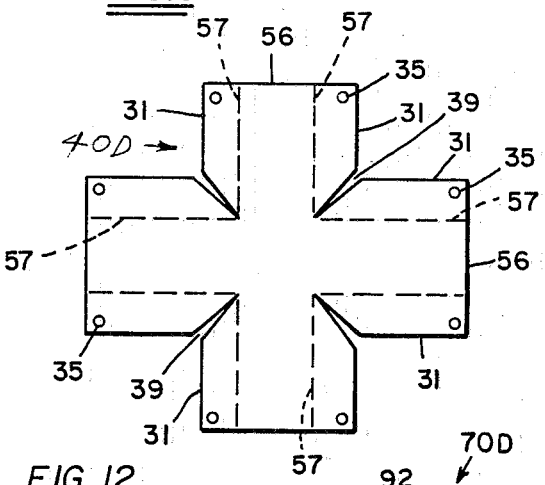
FIG. 9 is a top plan view of a patterned-piece utilizeable for manufacturing the angular cap second embodiment.

The four-wings roof-plate 50 and the eight rectangular vertical-plates 31 of cap embodiment 40 might be fabricated from a single partitioned-piece 40D of said sheet metal and having the shape substantially depicted in FIG. 9. Broken lines in FIG. 9 indicate linearities of patterned-piece 40D corresponding to the eventual locations of the wings secondary-edges 57. After the patterned-piece 40D is permanently bent at right angles along linearities 57, there results the appropriate four-wings roof-plate 50 and the eight rectangular vertical-plates 31. Finally, the four metallic gusset-plates M are attached to the bent patterned-piece to complete angular cap 40 for use at partitioning meeting station S3.

Figure 10:
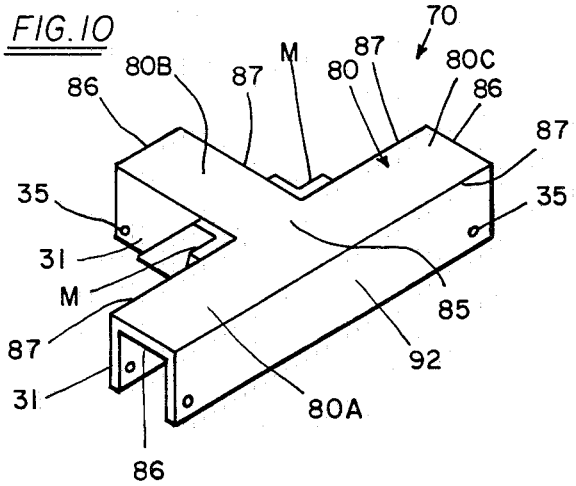
FIG. 10 is a perspective view of the outer-side of a third embodiment (70) angular cap of the present invention.
Figure 11:
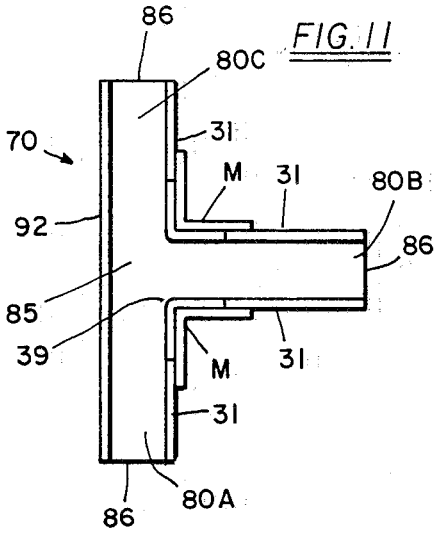
FIG. 11 is a bottom plan view and showing the inner-side of the third embodiment.

Turning now to drawing FIGS. 10–11 which depict a three-wings angular cap embodiment 70 adaptable for use at such partitioning meeting stations (e.g. S4) where individual partitions P meet in a T-shaped relationship. Horizontal planar roof-plate portion 80 includes three similarly lengthy and perpendicularly intersecting wings 80A, 80B, and 80C arranged in a T-shaped condition, each wing having three linearly extending prominent wing-edges. The three wing-edges including two substantially parallel secondary-edges 87 flanking a primary-edge 86. Of the three wing-edges, primary-edge 86 is located most remote from the roof-plate central-part 85 and perpendicularly intersects the two secondary-edges 87. Two of the secondary-edges, one each from wings 20A and 20C, are colinear whereby roof-plate 80 has a "double-length" secondary-edge besids the four "regular-length" secondary-edges i.e. two on wing 20B and one each on wings 20A and 20C.

In addition to roof-plate 80, angular cap embodiment 70 also includes five stiff vertical-plates (31, 92) respectively confined to and extending integrally perpendicularly downwardly from the respective roof-plate linear secondary-edges 87. One of the vertical-plates 92, i.e. that which depends from the "double-length" secondary-edge, is correspondingly at least twice lengthier than the four remaining rectangular vertical-plates (31). The three primary-edges 86 of roof-plate 80 are devoid of any downward extensions. The two "regular-length" vertical-plates from the respective neighboring wings define two upright right-angled corners for embodiment 70, and each said corner being equipped with a gusset-plate reinforcement dress M at the cap outer-side. Hence, as shown in drawing FIGS. 13–14, said two gusset-plates M, confined to the vertical-plates outer-faces, are in non-interfering relationship to the required snug abutment between the individual partitions upright-faces F at partitioning station S4.

Figure 12:
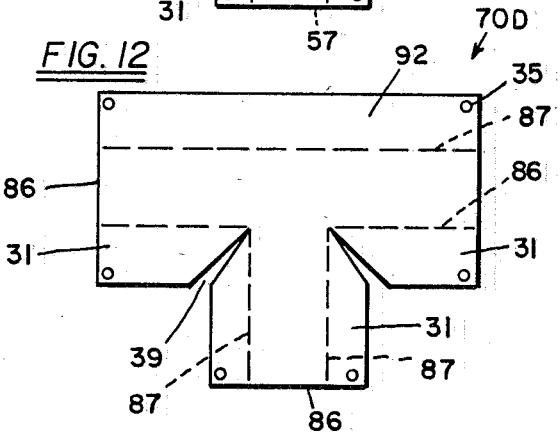
FIG. 12 is a top plan view of a patterned-piece utilizeable for manufacturing the angular cap third embodiment.

The three-wings roof-plate 80 and the five rectangular vertical-plates (31, 92) of cap embodiment 70 might be fabricated from a single patterned-piece 70D of said sheet metal and having the shape substantially depicted in FIG. 12. Broken lines in FIG. 12 indicate linearities of patterned-piece 70D corresponding to the eventual locations of the wings secodary-edges 87. After the patterned-piece is permanently bent at right angles along linearities 87, there results the appropriate three-wings roof-plate 80, the "double-length" rectangular vertical-plate 92, and the four "regular-length" rectangular vertical-plates 31. Finally, the two metallic gusset-plates M are attached to the bent patterned-piece to complete angular cap 70 for use at partitioning meeting station S4.

Although having already been alluded to, FIG. 13 shows the angular caps appropriately installed at upper portions of the representative partitioning meeting stations, namely, embodiment 10 at meeting stations S1 and S2, embodiment 40 at meeting station S3, embodiment 70 at meeting station S4. In such installations, the angular caps obscure and aesthetically dress said meeting stations at the transversely extending discontinuities G. Moreover, by virtue of the stiff vertical-plates (31, 32, 92) depending from the unitary roof-plates (20, 50, 80) and snugly abutting both upright-faces of individual partitions, and perhaps augmented by fasteners extending through perforations 35, the partitioning (e.g. 110) is stabilized i.e. has improved resistance to transversely exending forces. The FIG. 14 sectional elevational view is directed to angular cap embodiments 40 and 70 at partitioning meeting stations S3 and S4, respectively, while the FIG. 15 elevational view is more particularly directed to cap embodiment 10 at a representative L-shaped partitioning meeting station S2, Analagously, embodiment 10 is employable at station S1.

Figure 16:
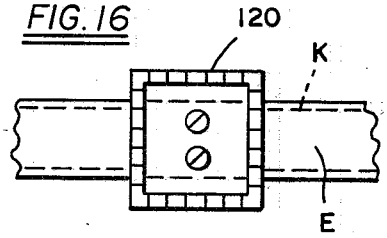
FIG. 16 is a sectional view taken along line 16—16 of FIG. 15.

Drawing FIGS. 15 and 16 also depict an embodiment 120 of a serrated foot-plate depending from the partitioning and being adapted to frictionally engage the carpet overlay (102) of office-flooring 101. With the foot-plate serrations thus tenaciously engaging the carpeting (102), it is unnecessary to laboriously bore into or otherwise invade the hard office-flooring (101) ancillary to providing a lower anchor for the partitioning. Though foot-plate embodiment 120 is of quadrangular annular plan view shape and is carried by the base-channel (EC) base-edge (E), such serrated foot-plate might be of other shapes and might be attached to other parts of the partitioning for similar carpet engaging results.

From the foregoing, the office partitioning angular caps and serrated foot-plates will be readily understood and further explanation is believed to be unnecessary. However, since numerous modifications and changes, in the angular caps, in the foot-plates, and in the office partitioning, will readily occur to those skilled in the art, it is not desired to limit the invention to the exact constructions shown and described. Accordingly, further modifications and equivalents may be resorted to, as encompassed by the scope of the appended claims.

I claim:

1. For use within an office environment comprising horizontal office-flooring and office-ceiling and both being at least partially bounded by vertically extending ceiling-height office-walls, said office environment further including less than ceiling-height partitioning comprising individual upright partitions angularly meeting at partitioning meeting stations located remote of said office-walls and respective partitions having a linearly extending horizontal base-edge and a linearly extending horizontal top-edge, individual partitions having a pair of substantially parallel upright-faces depending from said top-edge and partitions extending vertically of said office-flooring whereby the top-edges overly the base-edges, each of said partitioning meeting stations including at least two horizontally extending top-edges of different vertical partitions meeting in approximately vertically abutting relationship but including at least one transversely extending intervening discontinuity thereat whereby, because of said loftily positioned discontinuity between meeting partitions, said partitioning upper portion has a non-aesthetic appearance and has lesser stability toward transversely extending forces than along respective base-edges, an angular cap for for aesthetically dressing and stabilizing said office partitioning at the transversely extending discontinuity between meeting top-edges of individual partitions, said angular cap comprising:

(a) a horizontal roof-plate adaped to be superimposed along partitions top-edges and the intervening discontinuity of a partitioning meeting station, said roof-plate including at least two wings and all of which merge together at a roof-plate central-part adapted to be superimposed upon said transversely extending discontinuity, each wing having three linearly extending prominent wing-edges including a primary-edge located most remote from the roof-plate central-part and including two substantially parallel secondary-edges;

(b) a plurality of stiff vertical-plates respectively confined to and extending integrally downwardly from the respective roof-plate secondary-edges, each vertical-plate including an inner-face located on the inner-side of the angular cap and an outer-face located on the outer-side of the angular cap, two vertical-plates from neighboring roof-plate wings defining a right-angled corner, and the vertical-plates of the same roof-plate wing being adapted to snugly abut both upright-faces of an individual partition at a said partitioning meeting station; and (c) said roof-plate and all said vertical-plates being provided from a single patterned-piece of metallic sheet material having a sliver-like cutaway portion for each said right-angled corner, and the angular cap outer-side at each said right-angled corner carrying a dual-trapezoidal gusset-plate reinforcement attached to the outer-face of both vertical-plates thereat and in non-interfering relationship to the two inner-faces of each said right-angled corner.

2. The angular cap of claim 1 wherein the roof-plate includes two similarly lengthy and perpendicularly intersecting wings arranged in an L-shaped plan view condition; and wherein there are for the angular cap: two primary-edges, four secondary-edges, and four vertical-plates.

3. The angular cap of claim 2 wherein the entire respective wings of the roof-plate and together with all four vertical-plates are provided from a single patterned-piece of metallic sheet material.

4. The angular cap of claim 1 wherein the roof-plate includes four similarly lengthy and perpendicularly intersecting wings arranged in a +-shaped plan view condition; and wherein there are for the angular cap: four primary-edges, eight secondary-edges, four right-angled corners, and eight vertical-plates.

5. The angular cap of claim 1 wherein the roof-plate includes three similarly lengthy and perpendicularly intersecting wings arranged in a T-shaped plan view condition; and wherein there are for the angular cap: three primary-edges, two right-angled corners, five secondary-eges and one of which is at least twice lengthier than any one of the four remaining secondary-edges, and five vertical-plates and one of which is at least twice lengthier than any one of the four remaining vertical plates.

6. The angular cap of claim 1 for use with the improved office environment wherein the office-flooring is carpeted; and wherein individual partitions include a serrated foot-plate of quadrangular annular shape depending from the partition base-edge and is adapted to frictionally engage a said carpeted office-flooring.

7. The angular cap of claim 1 wherein each of the vertical-plates is provided with at least one perforation therethrough.

8. In combination with office partitioning comprising individual upright partitions angularly meeting at partitioning meeting stations and respective partitions having linearly extending base-edge and top-edge and a pair of substantially parallel upright-faces depending from said top-edge, each of said partitioning meeting stations including at least two horizontally extending top-edges of different upright partitions meeting in approximately vertically abutting relationship but including at least one transversely extending intervening discontinuity thereat, an angular cap aesthetically dressing and stabilizing said office partitioning at the transversely extending discontinuity-type meeting stations of individual partitions, and said combination further comprising:

(a) a horizontal roof-plate superimposed along partitions top-edges and the intervening discontinuity of a partitioning meeting station, said roof-plate including at least two wings and all wings merging together at a roof-plate central-part superimposed upon said meeting station discontinuity, each wing having three linearly extending prominent wing-edges including a primary-edge located most remote from the roof-plate central-part and two substantially paralel secondary-edges flanking said primary-edge;

(b) a plurality of stiff vertical-plates respectively confined to and extending integrally downwardly from the respective roof-plate secondary-edges, each vertical-plate including an inner-face located on the inner-side of the angular cap and an outer-face located on the outer-side of the angular cap, two vertical-plates from neighboring roof-plate wings defining a right-angled corner, and the vertical-plate of each roof-plate wing snugly abuttng both upright-faces of an individual partition at said partitioning meeting station; and (c) said roof-plate and all said vertical-plates being provided of a single patterned-piece of metallic sheet material having a sliver-like cutaway portion for each said right-angled corner, and the angular cap outer-side at each said right-angled corner carrying a dual-trapezoidal gusset-plate reinforcement attached to the outer-face of both vertical-plates thereat and in non-interfering relationship to both upright-faces of individual partitions at said partitioning meeting station.

9. The combination of claim 8 wherein individual partitions include a serrated foot-plate of quadrangular annular shape depending from the partition base-edge and frictionally engaging carpeted office-flooring therebelow.

10. The combination of claim 9 wherein each serrated foot-plate is of quadrangular annular shape and is attached to the partitioning base-edge with upright mechanical fastener means surrounded by the quadrangular serrated annular configuration thereof.

* * * * *